US008529186B2

(12) United States Patent
Klein

(10) Patent No.: US 8,529,186 B2
(45) Date of Patent: Sep. 10, 2013

(54) COLLECTING AND TRANSPORT DEVICE FOR A STACK FORMED BY LAYERS OF SHEETS

(75) Inventor: Hansjoerg Klein, Neuffen (DE)

(73) Assignee: BIELOMATIK LEUZE GmbH + Co. KG, Neuffen (DE)

( * ) Notice: Subject to any disclaimer, the term of this patent is extended or adjusted under 35 U.S.C. 154(b) by 290 days.

(21) Appl. No.: 13/002,789

(22) PCT Filed: Sep. 16, 2009

(86) PCT No.: PCT/EP2009/006679

§ 371 (c)(1),
(2), (4) Date: Jan. 17, 2011

(87) PCT Pub. No.: WO2010/031538

PCT Pub. Date: Mar. 25, 2010

(65) Prior Publication Data

US 2011/0158781 A1 Jun. 30, 2011

(30) Foreign Application Priority Data

Sep. 17, 2008 (DE) ..... 10 2008 047 785

(51) Int. Cl.

| | |
|---|---|
| ***B65H 31/30*** | (2006.01) |
| ***B65H 31/28*** | (2006.01) |
| ***B65G 15/50*** | (2006.01) |
| ***B65G 47/53*** | (2006.01) |
| ***B65G 47/71*** | (2006.01) |

(52) U.S. Cl.
USPC ..... 414/789.1; 414/900

(58) Field of Classification Search
USPC ..... 198/370.07, 468.3, 468.7, 890; 271/210, 271/221, 222, 224; 414/157, 158, 166, 17, 414/198, 214, 222.1, 416.11, 676, 788.9, 414/789.1, 789.9, 790, 790.1, 790.2, 790.3, 414/790.4, 790.6, 790.8, 792.1, 794.7, 900
See application file for complete search history.

(56) References Cited

U.S. PATENT DOCUMENTS

| | | | | | |
|---|---|---|---|---|---|
| 3,580,145 | A | * | 5/1971 | Vermes | 414/788.4 |
| 3,662,901 | A | * | 5/1972 | Brintley, Sr. | 414/789.1 |
| 3,713,651 | A | * | 1/1973 | Abler et al. | 271/221 |
| 3,977,671 | A | * | 8/1976 | Taylor et al. | 271/221 |
| 4,511,300 | A | * | 4/1985 | Lampe et al. | 414/788.9 |
| 4,787,621 | A | * | 11/1988 | Sattler | 271/221 |
| 5,575,612 | A | * | 11/1996 | Uno | 414/788.9 |

(Continued)

FOREIGN PATENT DOCUMENTS

| | | | |
|---|---|---|---|
| DE | 4216123 | A | 11/1993 |
| DE | 19829094 | A | 1/2000 |

(Continued)

*Primary Examiner* — Gregory Adams
(74) *Attorney, Agent, or Firm* — Andrew Wilford

(57) ABSTRACT

The invention relates to a collecting and conveying device for stacks of sheet layers, comprising a feed conveyor (1) for the sheet layers, —a collecting station (3) in which stacks (4) are formed by the layers of sheets, —a removal conveyor (7) for removing the completed stacks (4), and—a transfer unit for moving the stacks from the collecting station to the removal conveyor (7), wherein the collecting station comprises a series of support elements (6) and a series of delimiting and shaking elements (8), wherein the transfer unit comprises a series of sliding elements (10), wherein in each case a sliding element (10) together with a support element (6) and a delimiting and shaking element (8) can be adjusted transversely.

3 Claims, 4 Drawing Sheets

(56) References Cited

U.S. PATENT DOCUMENTS

| | | | | |
|---|---|---|---|---|
| 6,364,312 | B1 * | 4/2002 | Ramcke | 271/299 |
| 6,527,501 | B2 * | 3/2003 | Wolf | 414/789 |
| 2005/0000842 | A1 | 1/2005 | Timmerman | |
| 2005/0265815 | A1 * | 12/2005 | Rodi | 414/788.1 |
| 2007/0098540 | A1 * | 5/2007 | Hendricks et al. | 414/788.1 |
| 2007/0154292 | A1 * | 7/2007 | Gammerler et al. | 414/286 |

FOREIGN PATENT DOCUMENTS

| | | | | |
|---|---|---|---|---|
| DE | 102004056018 | A | | 5/2006 |
| DE | 102005048217 | A | | 4/2007 |
| JP | 08026571 | A | * | 1/1996 |
| WO | WO 2007147452 | A1 | * | 12/2007 |

* cited by examiner

COLLECTING AND TRANSPORT DEVICE FOR A STACK FORMED BY LAYERS OF SHEETS

CROSS REFERENCE TO RELATED APPLICATIONS

This application is the US national stage of PCT application PCT/EP2009/006679, filed 16 Sep. 2009, published 25 Mar. 2010 as WO2010/031538, and claiming the priority of German patent application 102008047785.0 itself filed 17 Sep. 2008, whose entire disclosures are herewith incorporated by reference.

The invention relates to a collecting and transport apparatus for stacks formed by sheets with a supply conveyor for the sheets, a collecting station in which stacks are formed from the sheets, an output conveyor for carrying off the finished stacks and a transfer apparatus for moving the stacks from the collecting station to the output conveyor.

A collecting and transport apparatus with these features is described in DE 10 2004 056 018 A1. The collecting and conveying apparatus is part of a paper-processing machine in which paper strips are cut to length in a defined format by longitudinal and transverse cutters to form sheets that are collected to form sheet stacks that are subsequently packaged.

The sheets that are delivered continuously in rows next to one another and in overlapping form are collected in the collecting station until the stacks each have the desired number of sheets. The sheet stacks formed next to one another are conveyed by a transfer apparatus that has a number of slides and movable grabs corresponding to the number of stacks formed from the collecting station onto an output conveyor formed as a transverse conveyor. The transverse conveyor transports the rows of stacks to downstream packaging apparatuses in which the stacks are packed.

With a format change, the individual elements of the collecting station must be repositioned transversely according to format width and number of stacks. In operation, in particular with the transfer of the finished stacks, a collision of individual elements must not occur. Since for the formation of eight stacks and more next to one another a plurality of stack-forming elements are necessary, with a format change a large number of parts must be adjusted without collisions occurring.

The object of the invention is therefore to improve a collecting and transport apparatus of the type described such that a simplified transverse positioning to a new format is possible.

This object is attained with the features of claim 1.

Another object is to provide a collecting apparatus with conveyors that are simply designed and have a low construction height.

This object is attained with the features of claim 4.

The dependent claims recite particularly advantageous and hence preferred embodiments of the invention.

The apparatus is described in more detail below based on a preferred illustrated embodiment.

Figure 1:
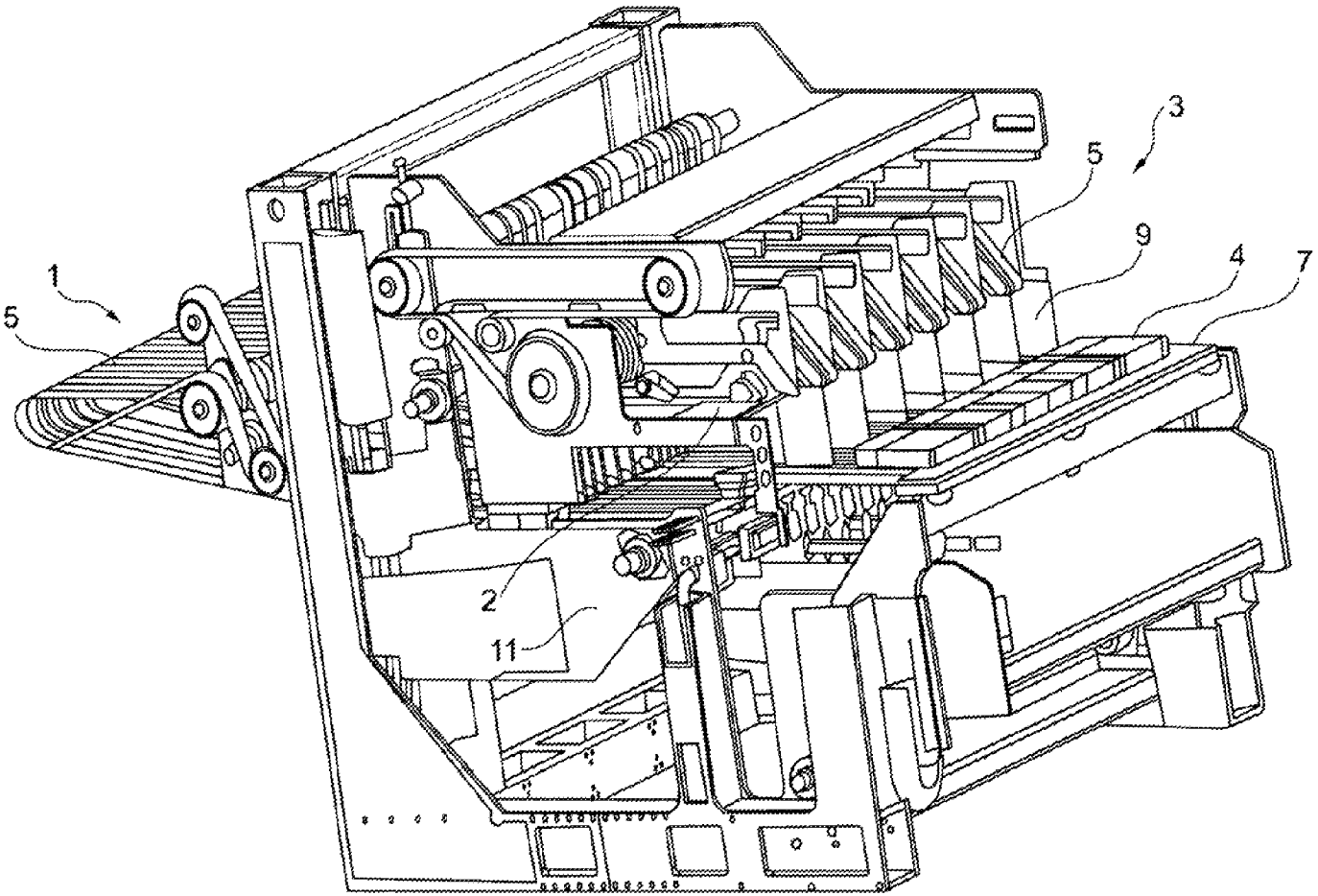
FIG. 1 is a perspective view of an apparatus according to the invention.
Figure 2:
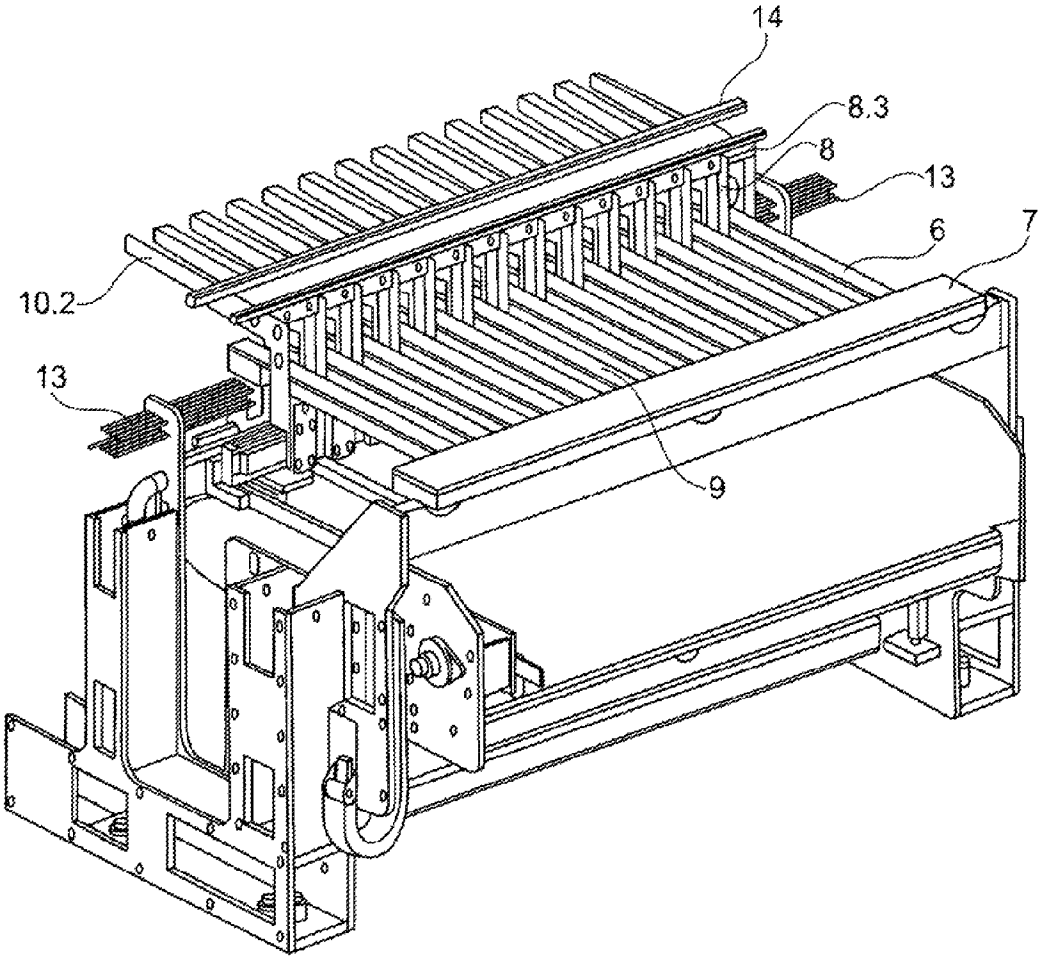
FIG. 2 is a detail view the vibratory stop elements.
Figure 3:
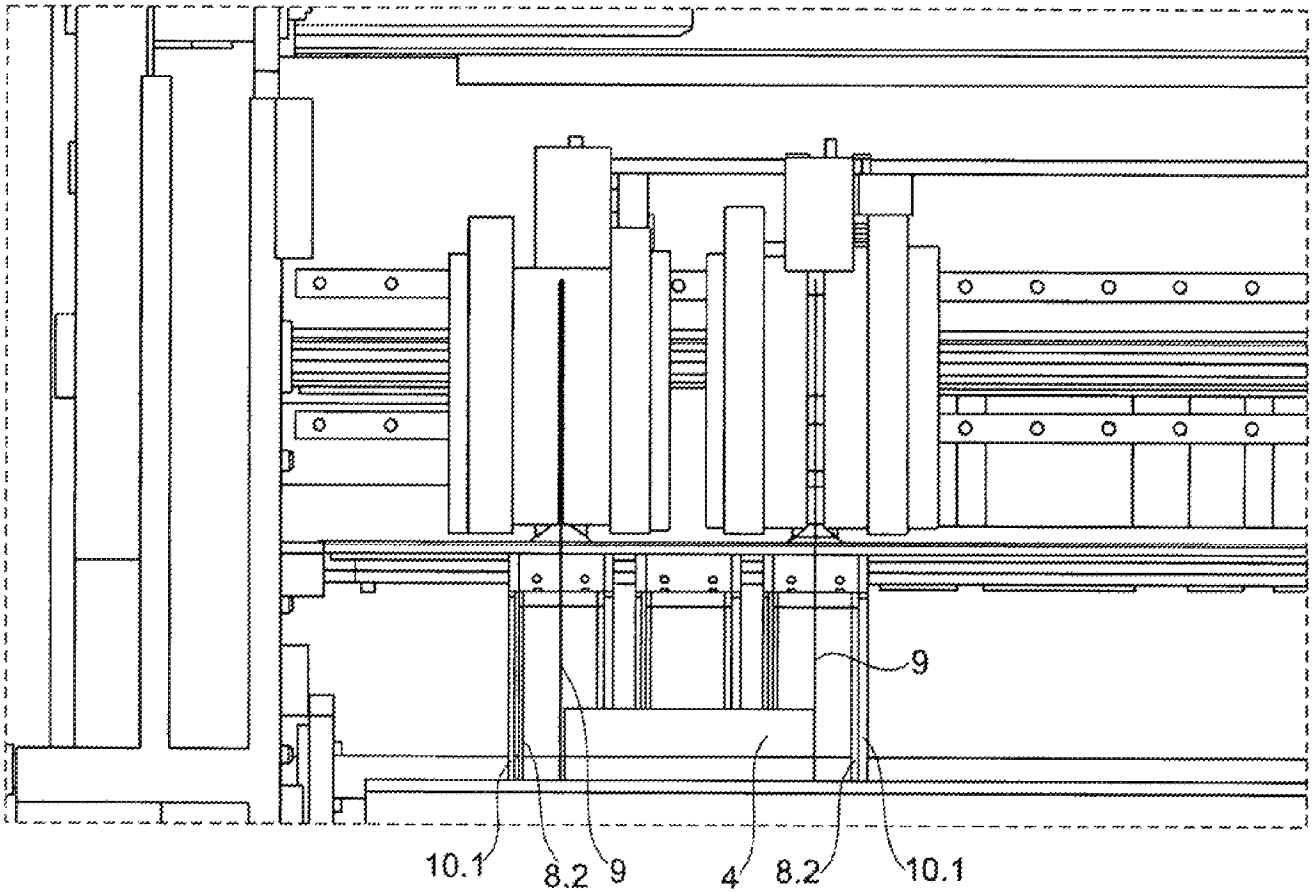
FIG. 3 is a detail view of the stacking station seen against the product travel direction.

The collecting and transport apparatus shown in FIGS. 1 and 2 is part of a paper-processing machine in which paper strips are cut to length in a defined format by longitudinal and transverse cutters to form sheets that are collected to form sheet stacks that are subsequently packaged. Preferably, the sheets are cut to length in the small format of A3 to A5 and subsequently collected to form stacks with between 200 and 500 sheets to a ream. Eight stacks or more can thereby be formed next to one another and subsequently transported away for further processing, for example, for wrapping.

The collecting and transport apparatus has a supply conveyor 1 that transport the sheets to a collecting station 3 in which stacks 4 are formed from the sheets. The supply conveyor 1 is preferably composed of a plurality of parallel rows of conveyor belts 5 that preferably extend into the region of the collecting station 3 to transport the sheets. Upstream of the stacking station, the sheets lie on a conveyor table 2.

The collecting station 3 is formed by rows of is transversely spaced supports 6 that extend in the production/travel direction and whose coplanar upper surfaces carry the stacks 4. A transverse conveyor 7 extends across the downstream ends of the supports 6 as an output conveyor that moves the finished sheet stacks 4 transversely of the production/travel direction to an unillustrated packing station.

Figure 4:
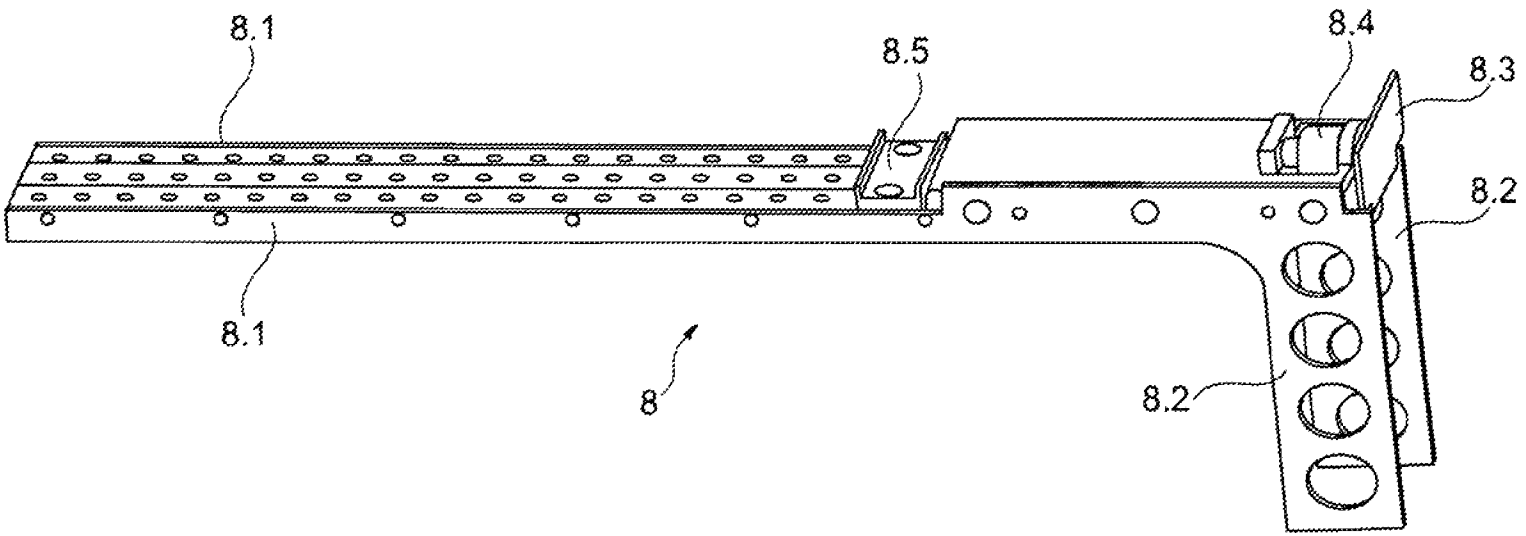
FIG. 4 shows a vibratory stop element for the trailing sheet edges.

At the collecting station 3 further stack-forming and transfer elements are provided that align edges of the sheets to form stacks 4 that are transferred to the transverse conveyor 7. The upstream end of the stacking station is formed by rows of vibratory stop elements 8, one of which is shown in more detail in FIG. 4. It is formed by two spaced and horizontally extending support parts 8.1 and, extending perpendicularly downwardly therefrom, respective stops 8.2 whose vertical downstream edges serve to align the sheets as they are stacked. To ensure correctly aligned edges, the sheets are vibrated as they are dropped onto the stacks. This is done by a respective vibratory plate 8.3 that projects downward between each pair of stop edges and that is vibrated by a respective drive 8.4. Respective holding plates 8.5 are attached on top of the pairs of support parts 8.1 and are fitted to a guide rail 14 extending transversely across the working width. The guide rail 14 carries the vibratory stop elements 8.

Vertical vibratory side plates 9 extending in the product travel direction between the supports 6 shake the side edges of the stacks 4 during stack formation. The leading edges of the sheets are arrested by stop elements extending transversely across the working width and not shown in the figures. The supports 6, the vibratory stop elements 8, the pairs of vibrating plates 9 and the stop elements thus during deposition of the sheets form open collecting boxes in which the stacks 4 are formed.

Slides 10 that are shown in more detail in FIG. 2 are used to push the finished stacks 4 out of the stack boxes in the production direction toward the transverse conveyor 7. Each slide 10 is formed by two vertical slide rails 10.1 that extend transversely of the product travel direction each outside and parallel to a respective one of the stops 8.2. A horizontal support rail 10.2 extends from each slide rail 10.1 next to the respective support part 8.1 of the respective element 8. The slide rails 10.1 push a finished stack 4 out of the respective collection box in the product travel direction, so that a new stack can be formed therein. Advantageously, sheets are intermediately stored on the support rails 10.2, while the finished stacks 4 are transported away. When the slides are moved back against the product travel direction, the intermediately stored sheets are transferred to the supports 6.

For the subsequent transfer of the stacks 4 to the transverse conveyor 7, elements are used that grip the stacks 4 firmly during transport in order to prevent the stacked sheets from slipping relative to one another. Suitable elements are carriages with clamping fingers that hold the stacks 4 such that their shapes are retained. These elements are not shown in the figures so that the other parts are visible.

The elements of the collecting and transport apparatus described above are supported in the frame of the apparatus in the is following manner:

The stop elements of the collection box and the transverse conveyor 7 are maintained stationary. The supply conveyor 5, the vibratory stop elements 8, the vibratory side plates 9 and the slides 10 are supported on vertically movable cheek plates 11 so that their vertical position can be adjusted to the growing stack heights. In addition, the slides 10 are moveable vertically and at the same time horizontally in and against the product travel direction relative to the other elements supported on the side cheek plates 11 by a drive, so that they can be raised and can slide. In order to be able to adjust the upstream end of the collection box depending on the format length of the sheets, the side cheek plates 11 with the elements attached thereto are also adjustably supported in a limited horizontal manner in and against the product travel direction.

In order that different format widths and numbers of sheet stacks can be processed, according to the invention the elements to be positioned transversely in a manner dependent on the format width and/or number of blanks are designed and supported in a particularly advantageous manner:

The vibratory side plates 9 acting on the stack sides are jointly transversely adjustable with the upper belts 5 that feed the sheets are guided into the stacking station. The vibratory side plates 9 are positioned between two adjacent parallel sheet stacks 4. If fewer stacks than possible are to be formed, the superfluous elements are moved into side parked positions.

In order to substantially reduce the number of transverse adjustments in a format change, one support 6, one respective vibratory stop element 8 and one respective slide 10 are jointly displaced transversely as a unit. To this end, the two slide rails 10.1 of a slide 10 are each provided outside a respective one of the two stops 8.2 of a respective vibratory stop element 8. The vibratory plate 8.3 is attached between the two respective stops 8.2. A support 6 forming the floor of a respective collection box is provided underneath the respective vibratory plate 8.3 and also between the respective stops 8.2. This design makes it possible for a single adjustment element, for example, an adjustment rod 13 bearing transversely on a stop 8.2 to adjust the entire unit composed of one support 6, one slide 10, and one vibratory stop element 8 transversely to the product travel direction and to position it for the new format width. This substantially simplifies the transverse positioning of the elements.

The two slide rails 10.1 of a slide 10 are preferably interconnected by a cross strip beneath the respective support 6, so that they can be moved upward without colliding with the vibratory stop element 8 and can be moved in and against the product travel direction without colliding with a vibratory side plate 9.

One or more conveyors are provided in a particularly advantageous manner for transporting the overlapping sheets and/or the stacks 4. The conveyors are formed or partially formed by planar faces of supports that are made from an open-pore ceramic. The pores have an average diameter of less than 100 μm. The supports are connected on their underside to a compressed air is supply so that compressed air exits the conveying surface and forms an air cushion exits so at to reduce friction with the sheets and/or stacks 4 to minimum values. This construction makes possible conveyors with very low construction height compared to conveyor belts. Thus transversely adjustable conveyor elements can be provided inside the region of the maximum height of fall of the sheets during stacking. With the collecting and transport apparatus, the supports 6, the transverse conveyor 7 and the inlet into the collecting station 3, in particular the guide table 2, are preferably made of open-pore ceramic plates.

The invention claimed is:

1. A collecting and transport apparatus for stacks formed by sheets with a supply conveyor for the sheets, a collecting station in which stacks are formed from the sheets, an output conveyor for carrying off the finished stacks, and a transfer apparatus for moving the stacks from the collecting station to the output conveyor, the collecting station having rows of supports and rows of vibratory stop elements, the transfer apparatus having rows of slides each transversely adjustable jointly with a respective one of the supports and a respective one of the vibratory stop elements.

2. The collecting and transport apparatus according to claim 1, wherein each slide 10, the respective support, and the respective vibratory stop element form a unit that is transversely adjustable by a single adjustment element.

3. The collecting and transport apparatus according to claim 1, wherein each vibratory stop element is formed by two respective horizontal and transversely spaced support parts from each of which a respective stop extends downward, a plate serving as vibrator is provided between two stops, a slide formed of two spaced slide rails extends laterally next to a respective support part of the respective stop element, and a support is arranged between the two support parts of the respective stop element.

* * * * *